United States Patent [19]

Battegazzore

[11] Patent Number: 4,776,496

[45] Date of Patent: Oct. 11, 1988

[54] DISPENSER OF GENERIC PASTE PRODUCTS AND SPECIFICALLY TOOTHPASTE

[75] Inventor: Piero Battegazzore, Alessandria, Italy

[73] Assignee: Guala S.p.A., Italy

[21] Appl. No.: 131,308

[22] Filed: Dec. 7, 1987

Related U.S. Application Data

[63] Continuation of Ser. No. 885,077, Jul. 14, 1986, abandoned.

[30] Foreign Application Priority Data

Mar. 17, 1985 [IT] Italy ..... 21251/86[U]
Jul. 18, 1985 [IT] Italy ..... 22541/85[U]

[51] Int. Cl.[4] ..... G01F 11/00; B67D 5/42

[52] U.S. Cl. ..... 222/209; 222/260; 222/387

[58] Field of Search ..... 222/207, 209, 256, 257, 222/259, 260, 321, 340, 341, 380, 383, 385, 386, 387, 391, 401, 402.12, 417, 517

[56] References Cited

U.S. PATENT DOCUMENTS

| | | | |
|---|---|---|---|
| 862,867 | 8/1907 | Eggleston | 417/390 |
| 3,088,636 | 5/1963 | Spatz . | |
| 3,154,224 | 10/1964 | Wakeman | 222/402.12 |
| 3,268,123 | 8/1966 | Spatz | 222/259 |
| 3,870,200 | 3/1975 | Spatz . | |
| 4,154,371 | 5/1979 | Kolaczinski et al. | 222/494 X |
| 4,301,948 | 11/1981 | Czech et al. | 222/341 |
| 4,413,759 | 11/1983 | Mettenbrink | 222/260 |
| 4,437,591 | 3/1984 | von Schuckmann | 222/391 |
| 4,456,153 | 6/1984 | Meshberg | 222/402.13 X |
| 4,511,068 | 4/1985 | Bossina | 222/257 |
| 4,538,747 | 9/1985 | von Schuckmann | 222/387 X |
| 4,598,843 | 7/1986 | Foster et al. | 222/387 X |
| 4,629,097 | 12/1986 | Moore | 222/260 X |
| 4,691,847 | 9/1987 | Ford et al. | 222/259 |
| 4,691,849 | 9/1987 | Tada | 222/383 X |

FOREIGN PATENT DOCUMENTS

| | | | |
|---|---|---|---|
| 3104726 | 8/1982 | Fed. Rep. of Germany | 222/386 |
| 1179304 | 1/1970 | United Kingdom | 222/402.12 |
| 2093921 | 12/1980 | United Kingdom . | |
| 2152152 | 7/1985 | United Kingdom . | |
| 2157372 | 10/1985 | United Kingdom . | |
| 2161222 | 1/1986 | United Kingdom . | |

*Primary Examiner*—Kevin P. Shaver
*Attorney, Agent, or Firm*—Angelo Notaro; Peter C. Michalos

[57] ABSTRACT

A dispenser of generic paste products and specifically toothpaste, of improved practicality and simple and easily assembled construction, comprises a cylindrical container, a head fitting at one end of the container, a bottom wall slidable sealingly in the container one way toward the head fitting, a pumping membrane, mounted within the container close against the head fitting, a delivery conduit associated with the pumping membrane, an actuating lever for the pumping membrane shiftable against the bias of a spring from a home position to a delivery stop position, and a tubular spout rigid with the head fitting and connected to said delivery spout as a continuation thereof.

20 Claims, 3 Drawing Sheets

DISPENSER OF GENERIC PASTE PRODUCTS AND SPECIFICALLY TOOTHPASTE

This application is a continuation of application Ser. No. 855,077, filed July 14, 1986, now abandoned.

DESCRIPTION

This invention relates to a dispenser of generic paste products, and specifically toothpaste, of a type which comprises a cylindrical container, a head fitting at one end of the container, a bottom wall arranged to slide sealingly in the container one way toward the head fitting, a pumping member mounted in the container close against the head fitting, a delivery conduit associated with the pumping member, and an actuating lever for the pumping member, shiftable against the bias of a spring from a home position to a delivery stop position.

Prior dispensers of the type outlined above, while being widely used, serving a purpose, and being generally satisfactory, still exhibit a disadvantage that restricts their utilization.

More specifically, a user holding the cylindrical container in one hand is bound to find that on depressing the actuating lever to dispense an amount of toothpaste onto the toothbrush, as held in the other hand, the delivery conduit tends to move about relatively to the hand-held container. Thus, the user is compelled to track the delivery conduit with the toothbrush, or vice versa, such that all the dispensed toothpaste can collect where intended and none goes wasted.

Dispensers of that type are, therefore, to be used in a somewhat unnatural fashion, and require in use somewhat skillful handling or acquisition of the knack of it.

It is the object of this invention to provide a dispenser as indicated, which has such constructional and operational features as to obviate the above-mentioned problem.

This object is achieved by a dispenser as indicated, which is characterized in that it comprises a tubular spout having an inlet mouth and an outlet mouth and being fast with the head fitting and connected to said delivery conduit in continuation thereof.

Advantageously, said tubular spout fits slidingly and sealingly to said conduit on the inlet mouth thereof.

Further features and the advantages of a dispenser according to the invention will become apparent from the following description of a preferred embodiment thereof, given here by way of illustration and not of limitation with reference to the accompanying drawing figures, wherein.

Figure 4:
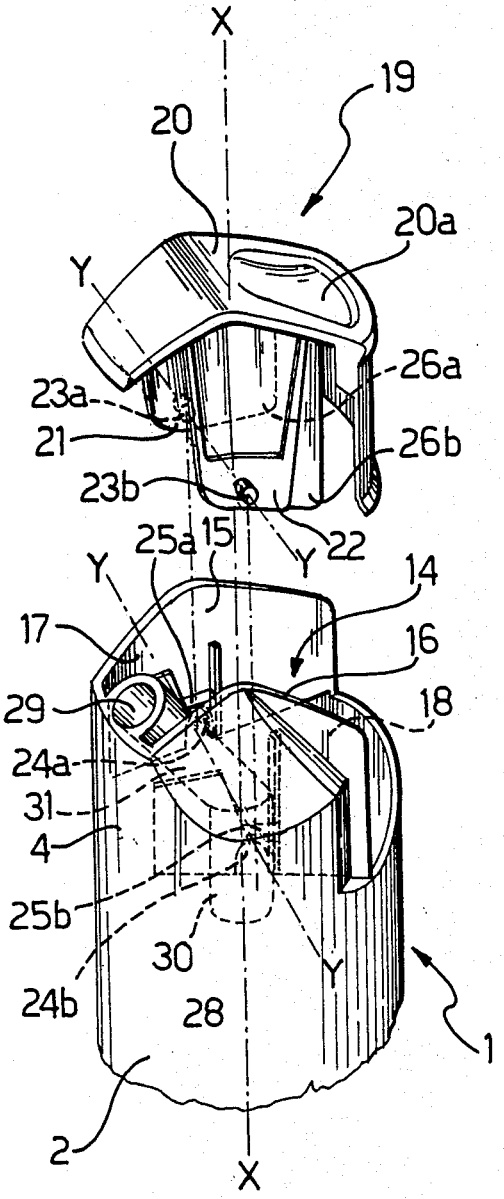
FIG. 4 shows an exploded perspective view of a detail of the dispenser of FIG. 1.
Figure 1:
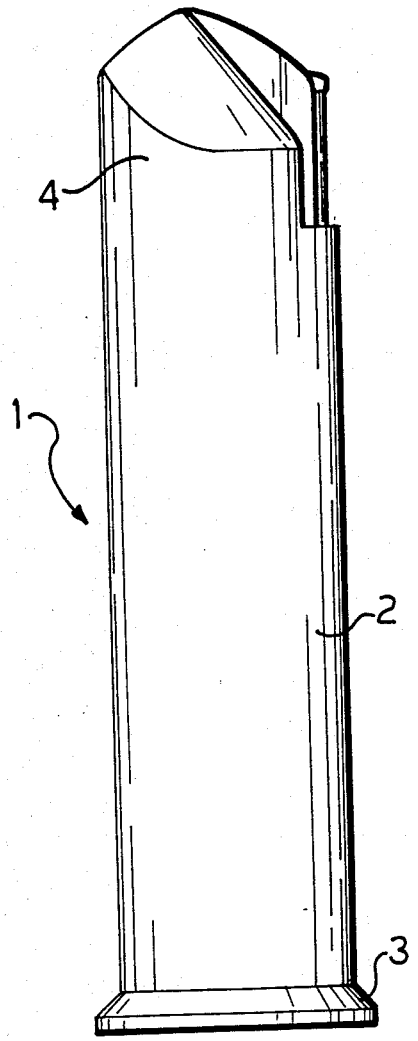
FIG. 1 is an elevation view of a dispenser according to the invention.

With reference to the accompanying drawing figures, generally indicated at 1 is a dispenser according to the invention, adapted for containing and dispensing generic paste products and, specifically, a toothpaste.

The dispenser 1 comprises a cylindrical container 2 of tubular shape with an axis X—X, wherein a ring-like folded out border 3 is formed at the container bottom end to provide a stand, and a head fitting 4 is formed at the container top end. The head fitting 4 is conveniently formed integrally with the cylindrical container 2.

Within the cylindrical container 2 there is mounted slidingly and sealingly a bottom wall 5. As will be explained hereinafter, the bottom wall 5 is movable one way from the stand 3 toward the head fitting 4, on account of a substantially Belleville washer 6 being fitted fitting peripherally around the edge of the bottom 5 and having an outward rim turned downwards to press onto the container 2. Also associated with the bottom 5 is an end cap 7, serving a closing wall and push-on function.

Within the cylindrical container 2, there is also mounted a pumping member 8, positioned close against the head fitting 4.

The container 2 contains a toothpaste to be dispensed in the space between the pumping member 8 and the bottom 5.

The dispenser 1 comprises a delivery conduit 9 of cylindrical shape with an axis X—X, which is associated with the pumping member 8.

The pumping member 8 includes a ring-like dome-shaped membrane 10 having an inward edge 11 and an outward edge 12.

The inward edge 11 of the membrane 10 is secured to the conduit 9. In particular, the membrane 10 and conduit 9 are of unitary construction, being preferably molded from a suitable plastics material, such as a thermoplastic elastomer.

It should be noted that such a single piece has increased thickness at the conduit to impart the spout with adequate stiffness, and has decreased thickness at the membrane, in order to impart the latter with adequate compliance along with an adequate elastic return property.

The outward edge 12 of the membrane 10 is retained axially to the cylindrical container 2 by an inner ring-like elevation 13 formed on the container 2 itself. The elevation 13 protrudes by a predetermined value, so as to hold the edge 12 axially against movement toward the bottom 5 of the container and to be overlapped by the membrane 10 in snap-action relationship as the latter is fitted, on assemblying the dispenser, into the cylindrical container 2 from the bottom 5 end.

The head fitting 4 has a central opening 14 which extends diametrically and has opposed, substantially diametrical edges 15 and 16.

From the head fitting 4 there extends, toward the exterior of the container 2 from said diametrical edges 15 and 16, two oppositely located walls 17 and 18.

The dispenser 1 further includes an actuating lever 19 for actuating the pumping member 8.

The actuating lever 19 comprises a plate-like element 20 having two opposed wings 21 and 22 which extend downwards at right angles and are set mutually apart to fit in between the walls 17 and 18 with a small clearance.

The actuating lever 19, which has a portion 20*a* at the plate-like element 20 anatomically configured for convenience in handling, is journalled, about a horizontal pivot axis Y—Y, to the head fitting 4 for engagement of two pins 23*a* and 23*b*, aligned to each other and projecting toward the exteriors of the wings 21 and 22, into semicircular pin seatings 24*a* and 24*b*, formed aligned along the axis Y—Y in the walls 17 and 18. It should be noted that in the walls 17 and 18 there are formed inclines 25*a* and 25*b* of invitation for the pins 23*a* and 23*b*, thereby the latter will snap fit in their respective seatings 24*a* and 24*b*.

Figure 5:
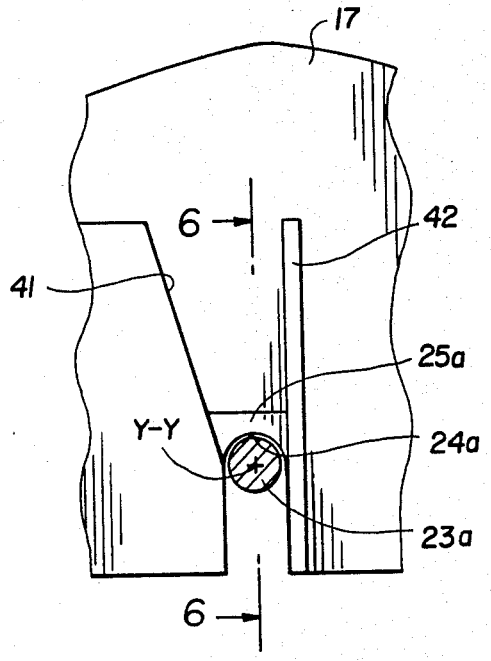
FIG. 5 is a side elevational view of the seating area for one wall of the dispenser.
Figure 6:
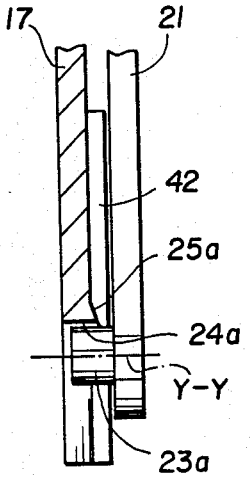
FIG. 6 is a sectional view taken along line 6—6 of FIG. 5.

As best shown in FIGS. 5 and 6, the incline 25*a* is just above the seating 24*a*. The seating 24*a* opens downwardly toward the bottom wall of the container. Pin 23*a* is also shown seated in the seating for pivotal movement about the axis Y—Y, this axis being fixed relative to the container. A guideway is also formed on both walls 17 and 18 between guides 41 and 42, for receiving the pins 23*a* and 23*b* as the lever 19 moves in the axial direction to bring the pins into engagement with their respective seatings.

The wings 21 and 22 have respective camming profiles 26*a* and 26*b* acting on the conduit 9 and, hence, on the membrane 10.

Figure 3:
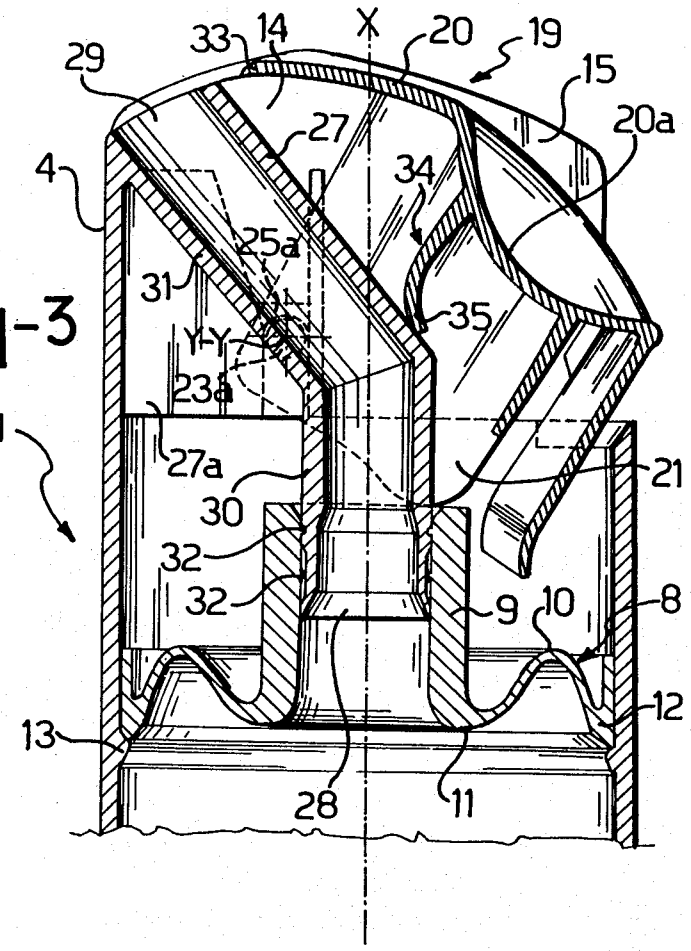
FIG. 3 is a sectional view, drawn to a still more enlarged scale, of a detail of the device of FIG. 1, shown at a different stage of its operation.
Figure 2:
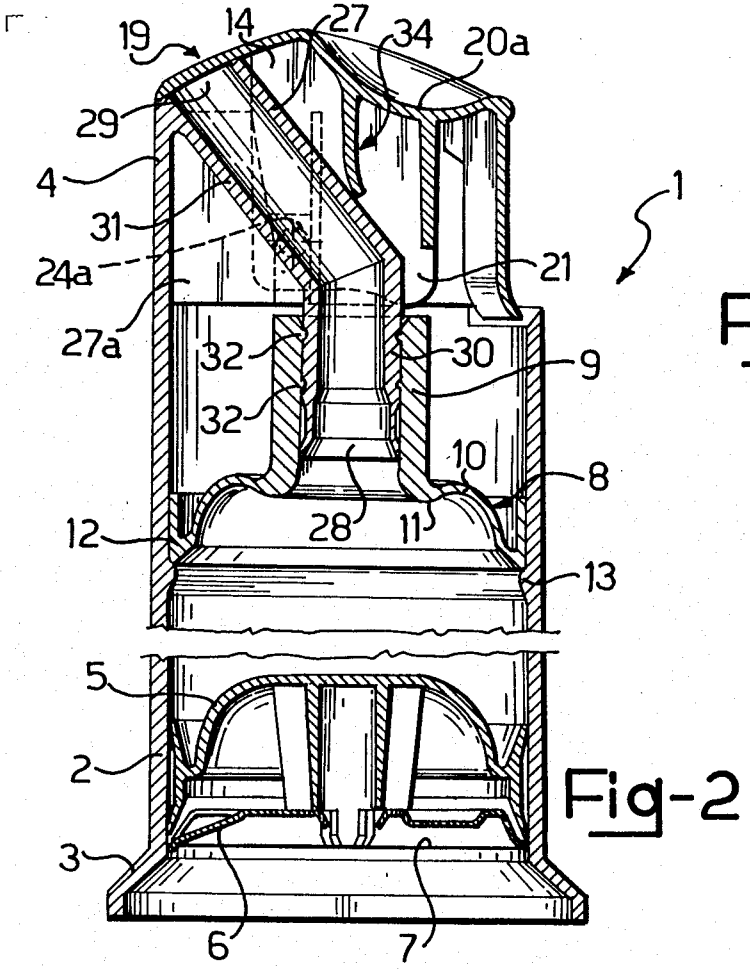
FIG. 2 is an enlarged scale sectional view through the dispenser of FIG. 1.

The lever 19 is movable, by acting on its portion 20*a* of anatomical shape, from a home position (see FIG. 2) into a delivery stop position (see FIG. 3).

The dispenser 1 according to the invention further comprises a tubular delivery spout 27 which is fast with the head fitting 4 and extends therethrough. The spout 27 is connected to the conduit 9 in continuation thereof. More specifically, the spout 27 has an inlet mouth 28 and an outlet mouth 29. It has a first section 30, on the same side as the inlet mouth 28, which extends vertically and coaxially with the axis X—X, and a second section 31, on the same side as the outlet mouth 29, forming an angle with the first section 30. Said second section 31 opens to the exterior of the head fitting 4 with its outlet mouth 29 level with the opening 14. Advantageously, the tubular delivery conduit is a unitary construction with the head fitting 4, and is connected thereto by a radial rib 27*a*. Such a unit including the spout 27, head fitting 4, and cylindrical container 2, is preferably formed by molding from a suitable plastics material, e.g. polypropylene.

The section 30 of the conduit 27 is slid tightly within the conduit 9. Accordingly, the conduit 9 is formed with annular projections, comprehensively designed 32, serving a seal function.

The tubular spout 27 is provided, at the outlet mouth 29 end thereof, with a closure eave 33 which is embodied by a lug formed integrally with the plate-like element 20 of the lever 19.

The eave 33 extends above the outlet mouth 29 to completely cover it when the lever 19 is in its home position, and is instead shifted clear of it to completely uncover it as the lever passes a predetermined intermediate position to the home and delivery stop ones.

It should be noted that the camming profiles 26*a* and 26*b*, with the lever in its home position, would be located at a set distance from the border 11, which distance is selected such that they will engage with the border 11 on said lever reaching said intermediate position. Thus, the lever is made to act on the pumping member 8 with a set angular delay from the home position, as required to fully uncover the outlet mouth. Said intermediate position correspond, therefore to a delivery starting position.

To return the lever 19 from the intermediate position or the delivery starting position to its home position, a spring 34 is provided which is embodied by a spring leaf 35 formed integrally with the lever and overhanging between the wings 21 and 22 and having its free end arranged to press onto the conduit 27.

In regards to the bottom 5, this is advantageously dome-shaped to substantially conform with the membrane 10.

To dispense a desired amount of toothpaste, the actuating lever 19 is depressed to complete a first angular movement from the home position to the delivery starting position, whereupon the eave 33 will move away from the outlet mouth 29 of the conduit 27, and then a second angular movement from the delivery starting position to the delivery stop position, whereupon the lever 20 will act on the membrane 10 to slightly flatten it in a downward direction. This will cause the toothpaste to flow up the spout 9 and the conduit 27 and be dispensed from the outlet mouth 29.

On releasing the lever, the membrane 10, on account of its elastic recovery, is returned to its original configuration and takes the conduit 9 and the lever itself back upwards. The leaf spring 35 will, in turn, return the lever from the delivery starting position to the home position thereof, causing the outlet mouth 29 to be covered by the eave 33.

While the membrane 10 returns to its original configuration, the movable bottom 5 will be pushed up by the atmospheric pressure.

It should be noted that in order to favor initial delivery of toothpaste, the spout 27 and conduit 9 should be primed with toothpaste by manually operating the end cap or pushbutton 7 on the movable bottom 5.

The dispenser may be used reiterately, as required, until the movable bottom moves up the container to contact the membrane. By that time, the contents in toothpaste is virtually depeleted and the dispenser may be thrown away.

The main advantage of the improved dispenser of this invention resides in its superior convenience in use resulting from that, as toothpaste is being dispensed by shifting the actuating lever relatively to the container, the outlet mouth is held stationary relatively to the container, thereby there need be no tracking between the hand holding the toothbrush and that holding the dispenser.

An additional advantage of the inventive device is of a hygienic order, and resides in that on completion of each toothpaste delivery cycle, the outlet mouth would be shut off automatically.

It should be further noted that, owing to the peculiar shape of the movable bottom, which conforms with that of the pumping member, virtually full utilization of the toothpaste contained in the dispenser is ensured.

Another advantage of the improved dispenser according to the invention comes from its simple construction and its being quickly assembled.

As will be understood, in fact, the dispenser of this invention comprises an unusually small number of parts, and can be easily assembled by a small number of operations, substantially by snap engage the parts together.

Of course, the dispenser disclosed hereinabove may be variously modified and changed by a skilled person in the art to meet the specific contingent requirements, without departing from the protection scope of the invention as defined in the appended claims.

I claim:

1. A dispenser of generic paste products and specifically, toothpaste, comprising a cylindrical container having a longitudinal axis, a head fitting at the upper end of the container, a bottom wall arranged to slide sealingly in the container one way toward the head fitting, a pumping member mounted in the container close against the head fitting, a conduit with a free end and with an opposed end associated with the pumping member, an actuating lever for moving the pumping member, projecting pins projecting from the lever along a pivot axis perpendicular to the longitudinal axis, said pivot axis being fixed relative to the container, said lever being angularly displaceable around the pivot axis of the cylindrical container from a home position to a paste delivery position, pin seatings formed in the head fitting for receiving said pins, a tubular spout having an inlet mouth and an outlet mouth being fixed to the head fitting, a closure eave formed integrally with the actuating lever and extending to cover the outlet mouth with the lever in the home position thereof, said actuating lever being provided with a cam profile for engagement with said free end of the conduit, said conduit being connected to said tubular spout in continuation thereof and sliding sealingly to said tubular spout at the same end as the inlet mouth, said pumping member comprising a flexible annular membrane having an outward edge held axially to the cylindrical container and an inward edge connected to the conduit.

2. A dispenser according to claim 1, wherein the projecting pins are integrally formed with the lever.

3. A dispenser according to claim 1, wherein said conduit is integrally formed with the flexible annular membrane of the pumping member.

4. A dispenser according to claim 1, wherein the head fitting is formed integrally with the cylindrical container.

5. A dispenser according to claim 1, wherein each of the conduit and the flexible annular member has a wall thickness, the wall thickness of the conduit being greater than the wall thickness of the flexible annular membrane.

6. A dispenser according to claim 1, wherein the cylindrical container includes an inner circumferential protuberance for axially restraining the outward edge against movement toward the bottom wall.

7. A dispenser according to claim 1, wherein said head fitting includes two spaced apart walls, and wherein said actuating lever comprises a plate-like element having two wings which extend at right angles to the plate-like element, said wings being set mutually apart to fit in between and closely to said walls of the head fitting, the wings and the walls being respectively provided with said projecting pins and pin seatings, said pins being received in said pin seatings.

8. A dispenser according to claim 7, wherein each pin seating includes a semicircular opening opened toward the bottom wall of the container.

9. A dispenser according to claim 7, wherein each pin seating comprises a semicircular opening opened toward the bottom wall of the container and including an incline for guiding the respective projecting pin whereby each of the pins, during the assembling, will snap fit into its respective pin seating.

10. A dispenser according to claim 7, wherein said cam profile of the actuating lever is formed on at least one of the wings.

11. A dispenser of generic paste products and specifically toothpaste, comprising a cylindrical container having a longitudinal axis, a head fitting at the upper end of the container, a bottom wall arranged to slide sealingly in the container one way toward the head fitting, a pumping member mounted in the container close against the head fitting, a conduit with a free end and with an opposed end associated with the pumping member, an actuating lever for moving the pumping member, projecting pins projecting from the lever along a pivot axis perpendicular to the longitudinal axis, said pivot axis being fixed relative to the container, said lever being angularly displaceable around the pivot axis of the cylindrical container from a home position to a paste delivery position, pin seatings formed in the head fitting for receiving said projecting pins, a tubular spout having an inlet mouth and an outlet mouth being fixed to the head fitting, a closure eave formed integrally with the actuating lever and extending to cover the outlet mouth with the lever in the home position thereof, said actuating lever being provided with a cam profile which is spaced out of contact from said free end of the conduit when the lever is in its home position and which is operatively engaged with the same said free end of the conduit upon an angular displacement of the lever at the end of which displacement the eave uncovers the outlet mouth of the spout, said conduit being connected to said tubular sprout in continuation thereof and sliding sealingly to said tubular sprout at the same end as the inlet mouth, said pumping member comprising a flexible annular membrane having an outward edge held axially to the cylindrical container and an inward edge connected to the conduit.

12. A dispenser according to claim 11, wherein said projecting pins are integrally formed with the lever.

13. A dispenser according to claim 11, wherein said conduit is integrally formed with the flexible annular membrane of the pumping member.

14. A dispenser according to claim 11, wherein the head fitting is formed integrally with the cylindrical container.

15. A dispenser according to claim 11, wherein each of the conduit and the flexible annular member has a wall thickness, the wall thickness of the conduit being greater than the wall thickness of the flexible annular membrane.

16. A dispenser according to claim 11, wherein the cylindrical container includes an inner circumferential protuberance for axially restraining the outward edge against movement toward the bottom wall.

17. A dispenser according to claim 11, wherein said head fitting includes a two spaced apart walls and wherein said actuating lever comprises a plate-like element having two wings which extend at right angles to the plate-like element, said wings being set mutually apart for fitting between and closely to said walls of the head fitting, the wings and the walls being respectively provided with said projecting pins and pin seatings, said projecting pins being received in said pin seatings.

18. A dispenser according to claim 17, wherein each pin seating includes a semicircular opening opened toward the bottom wall of the container.

19. A dispenser according to claim 17, wherein each pin seating comprises a semicircular opening opened toward the bottom wall of the container and including an incline for guiding the respective projecting pin, whereby each of the pins, during the assembling, will snap fit into its respective pin seating.

20. A dispenser according to claim 17, wherein said cam profile of the actuating lever is formed on at least one of the wings.

* * * * *